US007963827B2

(12) United States Patent
Sankaranarayanan

(10) Patent No.: US 7,963,827 B2
(45) Date of Patent: Jun. 21, 2011

(54) BACKINGLESS ABRASIVE ARTICLE

(75) Inventor: Ramaswamy Sankaranarayanan, Natick, MA (US)

(73) Assignees: Saint-Gobain Abrastives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 930 days.

(21) Appl. No.: 11/777,402

(22) Filed: Jul. 13, 2007

(65) Prior Publication Data

US 2008/0014840 A1 Jan. 17, 2008

Related U.S. Application Data

(60) Provisional application No. 60/831,165, filed on Jul. 14, 2006.

(51) Int. Cl.
*B24D 11/00* (2006.01)

(52) U.S. Cl. ..... 451/527; 51/297; 51/298; 451/533; 451/539

(58) Field of Classification Search ..... 51/297, 51/298, 307, 309; 451/527, 533, 538, 539, 451/550, 548
See application file for complete search history.

(56) References Cited

U.S. PATENT DOCUMENTS

| | | | | |
|---|---|---|---|---|
| 2,658,007 | A | 11/1953 | Cross et al. | |
| 3,667,170 | A * | 6/1972 | MacKay, Jr. | 451/521 |
| 3,670,467 | A | 6/1972 | Walker | |
| 4,288,570 | A | 9/1981 | Coran et al. | |
| 5,126,394 | A | 6/1992 | Revis et al. | |
| 5,152,917 | A | 10/1992 | Pieper et al. | |
| 5,155,945 | A | 10/1992 | Tyler et al. | |
| 5,170,593 | A | 12/1992 | Tyler et al. | |
| 5,187,904 | A | 2/1993 | Tyler et al. | |
| 5,295,332 | A | 3/1994 | Tyler et al. | |
| 5,423,718 | A | 6/1995 | Tyler et al. | |
| 5,607,488 | A | 3/1997 | Wiand | |
| 5,681,362 | A | 10/1997 | Wiand | |
| 5,727,993 | A | 3/1998 | Kodate | |
| 5,766,277 | A * | 6/1998 | DeVoe et al. | 51/295 |
| 5,807,161 | A * | 9/1998 | Manor et al. | 451/442 |
| 5,833,724 | A | 11/1998 | Wei et al. | |
| 5,849,052 | A | 12/1998 | Barber, Jr. | |
| 5,902,360 | A | 5/1999 | Linzell | |
| 5,984,989 | A | 11/1999 | Davison et al. | |
| 6,004,670 | A * | 12/1999 | Kobe et al. | 428/343 |
| 6,190,746 | B1 * | 2/2001 | Ishii et al. | 428/40.1 |
| 6,299,521 | B1 * | 10/2001 | Morimura et al. | 451/533 |
| 6,312,484 | B1 * | 11/2001 | Chou et al. | 51/298 |

(Continued)

FOREIGN PATENT DOCUMENTS

EP 0560059 B1 2/1996

(Continued)

OTHER PUBLICATIONS

Elastosil LR 3014/50, Wacker Silicones, 3 pgs, 2006, www.wacker.com.

(Continued)

*Primary Examiner* — Timothy V Eley
(74) *Attorney, Agent, or Firm* — Abel Law Group, LLP; Joseph P. Sullivan

(57) ABSTRACT

An abrasive article includes an abrasive layer having an array of protrusions. The abrasive layer has a thickness not greater than about 500 mils. The abrasive article is free of a backing layer.

16 Claims, 3 Drawing Sheets

U.S. PATENT DOCUMENTS

| | | | | |
|---|---|---|---|---|
| 6,352,471 | B1 * | 3/2002 | Bange et al. | 451/527 |
| 6,425,816 | B1 | 7/2002 | Roberts et al. | |
| 6,451,076 | B1 | 9/2002 | Nevoret et al. | |
| 6,500,053 | B2 * | 12/2002 | James et al. | 451/41 |
| 6,561,890 | B2 | 5/2003 | Tominaga | |
| 6,641,471 | B1 * | 11/2003 | Pinheiro et al. | 451/526 |
| 6,739,962 | B2 | 5/2004 | Roberts et al. | |
| 6,758,734 | B2 | 7/2004 | Braunschweig et al. | |
| 6,773,474 | B2 | 8/2004 | Koehnle et al. | |
| 6,786,801 | B2 * | 9/2004 | Mann | 451/28 |
| 6,838,149 | B2 * | 1/2005 | Lugg | 428/137 |
| 6,848,986 | B2 | 2/2005 | Kendall et al. | |
| 6,858,292 | B2 | 2/2005 | Kendall | |
| 6,866,559 | B2 * | 3/2005 | Lehman et al. | 451/8 |
| 6,884,157 | B2 | 4/2005 | Chesley et al. | |
| 7,008,312 | B2 | 3/2006 | Laubender et al. | |
| 2002/0016139 | A1 | 2/2002 | Hirokawa et al. | |
| 2002/0065032 | A1 | 5/2002 | Tominaga | |
| 2003/0113509 | A1 | 6/2003 | Lugg | |
| 2003/0114096 | A1 * | 6/2003 | Fritz et al. | 451/548 |
| 2005/0060945 | A1 | 3/2005 | Culler et al. | |
| 2005/0060947 | A1 | 3/2005 | McArdle et al. | |
| 2005/0064805 | A1 | 3/2005 | Culler et al. | |
| 2005/0097824 | A1 | 5/2005 | Braunschweig et al. | |
| 2005/0101225 | A1 | 5/2005 | Bright et al. | |
| 2005/0107011 | A1 | 5/2005 | Welygan et al. | |
| 2005/0164619 | A1 | 7/2005 | Soelch et al. | |
| 2005/0282480 | A1 | 12/2005 | Nelson et al. | |
| 2006/0010780 | A1 | 1/2006 | Hall et al. | |
| 2006/0026904 | A1 | 2/2006 | Woo | |
| 2006/0057336 | A1 | 3/2006 | Daley | |

FOREIGN PATENT DOCUMENTS

| | | | |
|---|---|---|---|
| EP | 1175965 | A2 | 1/2002 |
| EP | 0909146 | B1 | 4/2004 |
| EP | 1470892 | A1 | 10/2004 |
| EP | 1075354 | B1 | 12/2004 |
| EP | 1207011 | B1 | 1/2005 |
| EP | 1458523 | B1 | 5/2005 |
| EP | 1458524 | B1 | 3/2006 |
| GB | 479767 | A | 2/1938 |
| JP | 05043717 | | 2/1993 |
| JP | 06099356 | | 4/1994 |
| JP | 11114837 | | 4/1999 |
| JP | 2001181507 | A | 7/2001 |
| RU | 2176589 | C1 | 10/2001 |
| WO | 95/19242 | A | 7/1995 |
| WO | 9845087 | A1 | 10/1998 |
| WO | 9907515 | A1 | 2/1999 |
| WO | 0043159 | A1 | 7/2000 |
| WO | 02083395 | A1 | 10/2002 |
| WO | 2005035200 | A1 | 4/2005 |
| WO | 2005082576 | A1 | 9/2005 |
| WO | 2005115716 | A1 | 12/2005 |
| WO | 2006007036 | A1 | 1/2006 |
| WO | 2006007107 | A2 | 1/2006 |
| WO | 2006010141 | A2 | 1/2006 |

OTHER PUBLICATIONS 25-35% (Methylhydrosiloxane) 65-70% (Dimethylsiloxane) Copolymer, Material Safety Data Sheet, Gelest, Inc., Morrisville, PA, 3 pgs, 2002.

Elastosil LR 3003/50 US A, Wacker Silicones, 2 pgs, 2004, www.wacker.com.

Elastosil LR 3003/50 US B, Wacker Silicones, 2 pgs, 2004, www.wacker.com.

Elastosil LR 3003/50 US A,B, Wacker Silicones, 2 pgs, 2005, www.wacker.com.

"The Grades and Properties of Elastosil R Solid Silicone Rubber," Wacker Silicones, 22 pgs, www.wacker.com.

"Processing Elastosil LR Liquid Silicone Rubber," Wacker Silicones, 27 pgs, www.wacker.com.

Poly(Dimethylsiloxane), Vinyl Terminated—DMS-V31, Material Safety Data Sheet, Gelest, Inc., Morrisville, PA, 3 pgs, 2002.

Aerosil R 812 S Hydrophobic Fumed Silica, Degussa AG, www.degussa.com, www1.sivento.com/wps/portal/p3/kcxml/VcnRDsEwGEDhz_EEv412cznKJtakY1va . . . , 2 pgs, 2006.

Dow Corning HV Silicone Rubber, Dow Corning Corporation, www.dowcorning.com, 8 pgs, 2003.

Aerosil R 812 S Hydrophobic Fumed Silica, Degussa AG, www.aerosil.com, 2 pgs, Jun. 2004.

* cited by examiner

BACKINGLESS ABRASIVE ARTICLE

CORRESPONDING APPLICATION

The present application claims priority from U.S. Provisional Patent Application No. 60/831,165, filed Jul. 14, 2006, entitled "BACKINGLESS ABRASIVE ARTICLE," naming inventor Ramaswamy Sankaranarayanan, which application is incorporated by reference herein in its entirety.

FIELD OF THE DISCLOSURE

This disclosure, in general, relates to abrasive articles that are free of backing members.

BACKGROUND

Abrasive articles, such as coated abrasive articles and bonded abrasive articles, are used in various industries to machine work pieces, such as by lapping, grinding, or polishing. Machining utilizing abrasive articles spans a wide industrial scope from general finishing and material removal industrial applications, to optics industries and automotive paint repair industries to metal fabrication industries. In each of these examples, manufacturing facilities use abrasives to remove bulk material or affect surface characteristics of products.

Surface characteristics include gloss, texture, and uniformity. In particular, surface characteristics, such as roughness and gloss, may influence performance of optical media. Increasingly, optical media are used for data storage, particularly for digital entertainment including games, pictures, movies, and music. Surface scratches or poor surface quality may introduce errors when the optical media is accessed and in many cases, may make the optical media unreadable or unplayable. Particularly in situations in which the optical media is frequently reused or resold, surface repair is desired.

Surface characteristics also may influence quality in automotive paint repair. For example, when painting a surface, paint is typically sprayed on the surface and cured. The resulting painted surface has a pock marked orange peel texture or includes encapsulated dust defects. Typically, the painted surface is first sanded with a coarse grain abrasive and subsequently, sanded with fine grain engineered abrasives and buffed with wool or foam pads.

In addition to the surface characteristics, industries such as the optical media rental and resell industry or the automotive painting industry are sensitive to cost. Factors influencing the operational cost include the speed at which a surface can be prepared and the cost of the materials used to prepare that surface. Typically, the industry seeks cost effective materials having high material removal rates.

However, abrasives that exhibit high removal rates often exhibit poor performance in achieving desirable surface characteristics. Conversely, abrasives that produce desirable surface characteristics often have low material removal rates. For this reason, preparation of a surface is often a multi-step process using various grades of abrasive sheets. Typically, surface flaws introduced by one step are repaired using finer grain abrasives in a subsequent step. As such, abrasives that introduce fine scratches and surface flaws result in increased efforts in subsequent steps.

Typically, any increase in effort in any one step results in increased costs. For example, increased efforts include increased time utilized to improve the surface quality and an increased number of abrasive products used during that step. Both an increased time and an increased number of abrasive products used in a step lead to increased costs, resulting in disadvantages in the marketplace.

In CD, DVD, and game resell stores and rental providers, single-step surface repair of the optical media prior to subsequent rental or sale is preferred. Thus, both high removal rates and quality surface characteristics are desired from use of a single abrasive product. Poor quality surface characteristics may reduce the success of surface repair and thus, lead to loss of revenue from a CD or DVD and expense associated with the repurchase of the CD or DVD. On the other hand, low removal rates leads to low throughput and inefficiencies.

As such, a cost effective engineered abrasive article that provides improved surface characteristics when used would be desirable.

SUMMARY

In a particular embodiment, an abrasive article includes an abrasive layer having an array of protrusions. The abrasive layer has a thickness not greater than about 100 mils. The abrasive article is free of a backing layer.

In another exemplary embodiment, an abrasive article includes an abrasive layer having first and second major surfaces. The first major surface defines a set of protrusions extending from a first surface of the abrasive article. The abrasive article includes an adhesion layer in direct contact with the second major surface. The adhesion layer defines a second surface of the abrasive article.

In a further exemplary embodiment, an abrasive article includes an abrasive layer having first and second major surfaces. The first major surface defines a set of protrusions. The abrasive article also includes an adhesion layer in direct contact with the second major surface and includes a fastener layer in direct contact with the adhesion layer.

In a particular embodiment, an abrasive article is formed from a cured formulation. The formulation includes a liquid silicone rubber, a silica reinforcing particulate, and abrasive grains.

In another exemplary embodiment, a method includes blending a liquid silicone rubber, a silica reinforcing particulate, and abrasive grains to form a formulation. The method further includes forming a surface feature layer of the formulation and curing the formulation.

In a further exemplary embodiment, an abrasive article includes a layer comprising a silicone binder and abrasive grains. The layer has an elongation of at least about 50%.

In another exemplary embodiment, an abrasive article includes a surface feature layer configured to increase in surface area with wear. The surface feature layer includes a silicone binder and abrasive grains. The surface feature layer has a thickness not greater than about 500 mils. The abrasive article is free of a backing layer.

In a further exemplary embodiment, an abrasive article includes a layer having surface protrusions. The layer includes a silicone binder and abrasive grains. The abrasive article has a Gloss Performance of at least about 20.

In an additional embodiment, a method of finishing a painted surface includes abrading a painted surface with an abrasive article formed from a cured formulation. The formulation includes a liquid silicone rubber, a silica reinforcing particulate, and abrasive grains. The method further includes polishing the abraded painted surface.

In another exemplary embodiment, a method of finishing a painted surface includes abrading a painted surface with an abrasive article including a surface feature layer configured to increase in surface area with wear. The layer includes a silicone binder and abrasive grains. The abrasive article is free of a backing layer. The method further includes polishing the abraded painted surface.

BRIEF DESCRIPTION OF THE DRAWINGS

The present disclosure may be better understood, and its numerous features and advantages made apparent to those skilled in the art by referencing the accompanying drawings.

DESCRIPTION OF THE EMBODIMENTS

Figure 1:
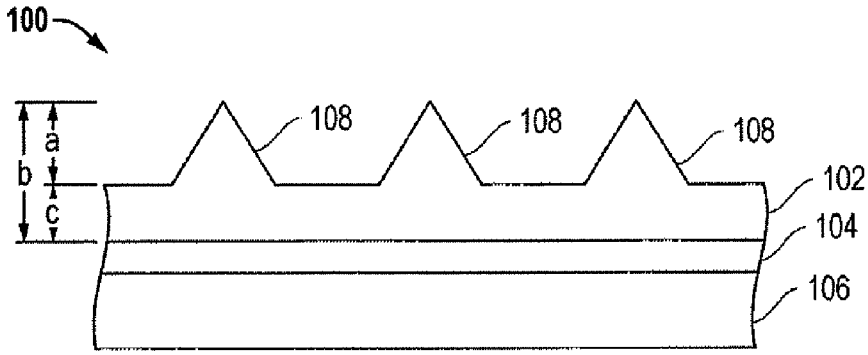
FIG. 1 includes an illustration of a cross-sectional view of an exemplary structured abrasive article.

In a particular embodiment, an abrasive article is formed from an abrasive formulation forming a layer of surface features. In an embodiment, the abrasive article is backless (i.e., free of a structural backing layer), such that the article is self-supporting. Particularly, the formulation forming the layer of surface features is self-supporting, such that the layer withstands use without structural degradation before the abrasive properties are consumed. In an example, the formulation includes a silicone resin, fine reinforcing particulate, and abrasive grains. In a particular example, the silicone resin is formed from a liquid silicone rubber, which typically includes a fine reinforcing particulate like silica. The surface feature layer includes an assembly of surface protrusions. The assembly of surface protrusions may be random, and in one embodiment, forms a pattern. In addition, the cross-section surface area may vary (generally, increase) during wear of the article, such as in the case of a sloping-sidewall surface protrusion (pyramidal, conical, prismatic, etc. surface protrusions), or may have generally constant cross-sectional surface area during wear, such as in the case of vertical-walled protrusions (rectangular, square, rod, etc. protrusions). In an exemplary embodiment, the abrasive article may also include an adhesion layer.

In another exemplary embodiment, a method of forming an abrasive article includes mixing a liquid silicone rubber and abrasive grains to form a formulation. The liquid silicone rubber usually includes silica reinforcing particulate. The formulation is used to form a surface feature layer, such as a surface feature layer that includes an assembly of surface protrusions as mentioned above. In addition, the method includes curing the formulation, forming the surface feature layer. Alternatively, a thermoplastic or other thermoset polymer may be used to form the abrasive article.

In an exemplary embodiment, the abrasive article includes a surface feature layer formed from a polymer formulation and abrasive grains. The polymer formulation may be a thermoplastic formulation. Alternatively, the polymer formulation may be a curable formulation. In a further example, the polymer formulation may be a combination of curable and thermoplastic formulations, such as a thermoplastic vulcanate. In a particular example, the thermoplastic formulation is a thermoplastic elastomer. In a further example, the polymer formulation may include a component that has a glass transition temperature not greater than about 25° C. For example, the polymer formulation may be a blend of polymers in which one of the polymers has a glass transition temperature not greater than about 25° C. or the polymer formulation may be a block copolymer in which a block component is characterized by a polymer unit that separately has a glass transition temperature not greater than about 25° C. In particular, the polymer formulation may include the low glass transition temperature component in an amount not greater than about 10 wt %, such as not greater than about 5 wt %, or even not greater than about 3 wt %.

An exemplary polymer formulation includes a polyamide-polyether copolymer; a polyester-polyether copolymer; an acrylic, acrylic copolymer, or modified acrylic copolymer, such as ethylene-methacrylate copolymer, ethylene-methacrylate-maleic anhydride copolymer, poly butyl methacrylate, or methyl methacrylate-butyl methacrylate copolymer; ethylene-vinylacetate copolymer; ethylene-vinylacetate-maleic anhydride copolymer; diene elastomer; thermoplastic polyurethane; blends of poly lactic acid and polycaprolactone-polysiloxane copolymer; silicone resin; or any blend or any combination thereof. An exemplary polyamide-polyether is available under the tradename Pebax available from Arkema, such as Pebax 2533. Exemplary acrylic polymers, including copolymers and modified copolymers, are available under the tradenames Orevac, Lotryl and Lotader, available from Arkema, or under Elvacite, available from Lucite. An exemplary polyester-polyether copolymer is available under the tradename Riteflex from Ticona. An exemplary thermoplastic polyurethane is available under the tradename Elastollan from BASF.

An exemplary diene elastomer includes a copolymer of ethylene, propylene and diene monomer (EPDM). An exemplary diene monomer includes a conjugated diene, such as butadiene, isoprene, chloroprene, or the like; a non-conjugated diene including from 5 to about 25 carbon atoms, such as 1,4-pentadiene, 1,4-hexadiene, 1,5-hexadiene, 2,5-dimethyl-1,5-hexadiene, 1,4-octadiene, or the like; a cyclic diene, such as cyclopentadiene, cyclohexadiene, cyclooctadiene, dicyclopentadiene, or the like; a vinyl cyclic ene, such as 1-vinyl-1-cyclopentene, 1-vinyl-1-cyclohexene, or the like; an alkylbicyclononadiene, such as 3-methylbicyclo-(4,2,1)-nona-3,7-diene, or the like; an indene, such as methyl tetrahydroindene, or the like; an alkenyl norbornene, such as 5-ethylidene-2-norbornene, 5-butylidene-2-norbornene, 2-methallyl-5-norbornene, 2-isopropenyl-5-norbornene, 5-(1,5-hexadienyl)-2-norbornene, 5-(3,7-octadienyl)-2-norbornene, or the like; a tricyclodiene, such as 3-methyltricyclo $(5,2,1,0^2,6)$-deca-3,8-diene or the like; or any combination thereof In a particular embodiment, the diene includes a non-conjugated diene. In another embodiment, the diene elastomer includes alkenyl norbornene. The diene elastomer may include, for example, ethylene from about 63 wt % to about 95 wt % of the polymer, propylene from about 5 wt % to about 37 wt %, and the diene monomer from about 0.2 wt % to about 15 wt %, based upon the total weight of the diene elastomer. In a particular example, the ethylene content is from about 70 wt % to about 90 wt %, propylene from about 17 wt % to about 31 wt %, and the diene monomer from about 2 wt % to about 10 wt % of the diene elastomer. Exemplary diene elastomers are commercially available under the tradename Nordel from Dow, such as Nordel IP 4725P or Nordel 4820.

In a particular embodiment, the polymer formulation includes a silicone resin. For example, the silicone resin may be formed from a high consistency silicone rubber (HCR) or a liquid silicone rubber (LSR), and can include reinforcing fumed silica filler. In a particular example, the silicone resin is formed from an LSR. In general, the silicone rubber, LSR or HCR, crosslinks to form the silicone resin, which forms a matrix in which the abrasive grains may be distributed or dispersed. Such a crosslinked silicone resin serves as a binder for the abrasive grains and is to be contrasted with uncrosslinked silicones that are configured to migrate to the surface of an abrasive article.

The silicone resin may also be formed from silicone oils, which are generally obtained free of fumed silica. In this case, the silicone oils, parts A and B, are blended with a catalyst, reinforcing particulate, such as fumed silica, and abrasive grains, and subsequently cured to form the silicone resin.

An exemplary silicone oil or silicone rubber includes a siloxane polymeric backbone to which functional groups may be attached. In an example, a functional group may include an un-reactive functional group such as a halogen group, a phenyl group, or an alkyl group, or any combination thereof. For example, a fluorosilicone may include a fluorine functional group attached to the backbone. In another exemplary embodiment, the siloxane backbone may be attached to a methyl, an ethyl, or a propyl group, or any combination thereof. In addition, the siloxane backbone may include reactive functional groups that function to encourage crosslinking. An exemplary reactive functional group includes a hydride group, a hydroxyl group, a vinyl group, or any combination thereof. For example, the siloxane polymer may include a polyfluorosiloxane, a polyphenylsiloxane, a polyalkylsiloxane, or any combination thereof, which have a reactive functional group, such as a vinyl termination. In a particular example, the silicone resin is formed from a base polysiloxane and a cross-linking agent. In an example, the cross-linking agent may be an organic cross-linking agent. In a particular example, the cross-linking agent is a silicone based cross-linking agent including reactive hydride functional groups.

The surface feature layer may be formed from an uncured formulation may include a liquid silicone rubber (LSR). For example, the uncured liquid silicone rubber may have a viscosity not greater than 600,000 cps when measure using test method DIN 53 019 at a shear rate of 10 $s^{-1}$. For example, the viscosity may be not greater than 450,000 cps, such as not greater than 400,000 cps. Typically, the viscosity is at least about 50,000 cps, such as at least about 100,000 cps. In a further example, the viscosity of silicone oil absent reinforcing particulate may be about 5 cps to about 165,000 cps.

In the case of cured formulations, the polymer formulation may be blended with abrasive grains and optionally reinforcing particulate prior to curing. In addition, various curing agents, catalysts, and thermal or photoinitiators and sensitizers may be added. In an exemplary embodiment, the silicone rubber is blended with abrasive grains to provide a formulation that is subsequently cured. In one example, the formulation may be cured using a peroxide catalyst. In another example, the formulation may be cured using a platinum catalyst. In a particular embodiment, a silicone includes a platinum catalyzed two-part liquid silicone rubber (LSR). The first part includes a vinyl terminated or grafted polyalkyl siloxane and the second part includes a crosslinking agent. In a particular example, the first part includes the catalyst and an inhibitor. In an additional example, the crosslinking agent may include a siloxane-based crosslinking agent, having a siloxane backbone attached to reactive functional groups, such as hydride or hydroxyl groups.

In general, the polymer formulation is blended with abrasive grains or reinforcing particulate prior to forming an abrasive article. When a thermoplastic polymer formulation is used, the abrasive grains or reinforcing particulate may be blended with the polymer formulation in a melted state. When the polymer formulation is a cured formulation, the abrasive grains or reinforcing particulate may be blended with the uncured components of the polymer formulation. Thus, when cooled or when cured, the polymer formulation, abrasive grains, and optional reinforcing particulate may form a composite material in which the abrasive grains and optional reinforcing particulate are distributed or dispersed throughout a polymer matrix.

In an exemplary embodiment, silicone oils are blended with reinforcing silica filler and abrasive grains to make a formulation that is subsequently cured. In an example, the silicone oils include two parts and a platinum or peroxide catalyst. The first part includes a vinyl terminated or grafted polyalkyl siloxane and the second part includes a crosslinking agent, such as polyhydroalkyl siloxane.

A polymer matrix formed of the polymer formulation may exhibit desirable mechanical properties, such that an abrasive layer formed from such a polymer formulation is self-supporting, enabling formation of a backless article. In particular, the polymer formulation may be used to form an abrasive layer that withstands use without structural degradation before the abrasive properties are consumed. For example, the polymer matrix, absent the abrasive grains, may exhibit desirable elongation-at-break, tensile strength, or tensile modulus. For example, absent the abrasive grains, the polymer matrix may exhibit an elongation-at break of at least about 50%, such as at least about 100%, at least about 200%, at least about 300%, at least about 350%, at least about 450%, or even at least about 500%, as determined using DIN 53 504 S1. In particular, absent abrasive grains, the silicone resin with the reinforcing silica filler may have an elongation-at-break of at least about 350%, such as at least about 450% or even, at least about 500% as determined using DIN 53 504 S1. In another example, the cured silicone resin absent the abrasive grains may have a tensile strength of at least about 10 MPa.

In an exemplary embodiment, the formulation forming the surface feature layer of the abrasive article may include a reinforcing particulate. For example, the reinforcing particulate may be incorporated in a silicone rubber. Alternatively, the reinforcing particulate may be added to a silicone oil in conjunction with preparing the formulation, such as just prior to adding the abrasive grains. An exemplary reinforcing particulate includes a silica particulate, an alumina particulate, or any combination thereof. In a particular example, the reinforcing particulate includes silica, such as fumed silica. An exemplary silica particulate is available from Degussa under the trade name Aerosil, such as Aerosil R812S, or available from Cabot Corporation, such as Cabosil M5 fumed silica. In another exemplary embodiment, the reinforcing silica may be incorporated into a liquid silicone rubber formulation, such as Elastosil 3003 formulations available from Wacker Silicones. In general, the reinforcing particulate is dispersed within the polymer matrix, and is typically mono-dispersed, being substantially agglomerate free.

In another exemplary embodiment, reinforcing particulate formed via solution-based processes, such as sol-formed and sol-gel formed ceramics, are particularly well suited for use in the formulation. Suitable sols are commercially available. For example, colloidal silicas in aqueous solutions are commercially available under such trade designations as "LUDOX" (E.I. DuPont de Nemours and Co., Inc. Wilmington, Del.), "NYACOL" (Nyacol Co., Ashland, Ma.) or "NALCO" (Nalco Chemical Co., Oak Brook, Ill.). Many commercially available sols are basic, being stabilized by alkali, such as sodium hydroxide, potassium hydroxide, or ammonium hydroxide. Additional examples of suitable colloidal silicas are described in U.S. Pat. No. 5,126,394, incorporated herein by reference. Especially well-suited are sol-formed silica and sol-formed alumina. The sols can be functionalized by reacting one or more appropriate surface-treatment agents with the inorganic oxide substrate particles in the sol.

In a particular embodiment, the reinforcing particulate is sub-micron sized. The reinforcing particulate may have a surface area in a range of about 50 $m^2/g$ to about 500 $m^2/g$, such as within a range of about 100 $m^2/g$ to about 400 $m^2/g$. The reinforcing particulate may be a nano-sized particulate, such as a particulate having an average particle size of about 3 nm to about 500 nm. In an exemplary embodiment, the reinforcing particulate has an average particle size of about 3 nm to about 200 nm, such as about 3 nm to about 100 nm, about 3 nm to about 50 nm, about 8 nm to about 30 nm, or about 10 nm to about 25 nm. In particular embodiments, the average particle size is not greater than about 500 nm, such as not greater than about 200 nm, or not greater than about 150 nm. For the reinforcing particulate, the average particle size may be defined as the particle size corresponding to the peak volume fraction in a small-angle neutron scattering (SANS) distribution curve or the particle size corresponding to 0.5 cumulative volume fraction of the SANS distribution curve.

The reinforcing particulate may also be characterized by a narrow distribution curve having a half-width not greater than about 2.0 times the average particle size. For example, the half-width may be not greater than about 1.5 or not greater than about 1.0. The half-width of the distribution is the width of the distribution curve at half its maximum height, such as half of the particle fraction at the distribution curve peak. In a particular embodiment, the particle size distribution curve is mono-modal. In an alternative embodiment, the particle size distribution is bi-modal or has more than one peak in the particle size distribution.

In an example, the reinforcing particulate is included in the formulation in an amount based on the combined weight of the silicone, the reinforcing particulate, and the abrasive grains. For example, the reinforcing particulate may be included in the formulation in an amount of at least about 3 wt % based on the total weight of the formulation, including reinforcing particulate, silicone resin, and abrasive grains. In particular, the formulation may include at least about 5 wt % of the reinforcing particulate or particulate, such as at least about 10 wt % of the reinforcing particulate, or even at least about 13 wt % of the reinforcing particulate. Further, the formulation may include not greater than about 60 wt % of the reinforcing particulate, such as not greater than about 50 wt % of the reinforcing particulate.

The formulation may further include abrasive grains. The abrasive grains may be formed of any one of or a combination of abrasive grains, including silica, alumina (fused or sintered), zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, emery, or any combination thereof. For example, the abrasive grains may be selected from a group consisting of silica, alumina, zirconia, silicon carbide, silicon nitride, boron nitride, garnet, diamond, cofused alumina zirconia, ceria, titanium diboride, boron carbide, flint, emery, alumina nitride, or a blend thereof. In particular, the abrasive grains may be selected from the group consisting of nitrides, oxides, carbides, or any combination thereof. In an example, the nitride may be selected from the group consisting of cubic boron nitride, silicon nitride, or any combination thereof. In another example, the oxide may be selected from the group consisting of silica, alumina, zirconia, zirconia/alumina oxides, ceria, titanium dioxide, tin oxide, iron oxide, chromia, or any combination thereof. In a further example, the carbide may be selected from the group consisting of silicon carbide, boron carbide, tungsten carbide, titanium carbide, or any combination thereof, and in particular may include silicone carbide. Particular embodiments use dense abrasive grains comprised principally of alpha-alumina. In another particular example, the abrasive grains include silicone carbide.

The abrasive grain may also have a particular shape. An example of such a shape includes a rod, a triangle, a pyramid, a cone, a solid sphere, a hollow sphere, or the like. Alternatively, the abrasive grain may be randomly shaped.

The abrasive grains generally have an average grain size not greater than 2000 microns, such as not greater than about 1500 microns. In another example, the abrasive grain size is not greater than about 750 microns, such as not greater than about 350 microns. For example, the abrasive grain size may be at least 0.1 microns, such as about 0.1 microns to about 1500 microns, and more typically about 0.1 microns to about 200 microns or about 1 micron to about 100 microns. The grain size of the abrasive grains is typically specified to be the longest dimension of the abrasive grain. Generally, there is a range distribution of grain sizes. In some instances, the grain size distribution is tightly controlled.

In an exemplary formulation, the abrasive grains provide about 10% to about 90%, such as from about 30% to about 80%, of the weight of the formulation. In an exemplary embodiment, the formulation includes at least about 30 wt % of the abrasive grains based on the total weight of the formulation. For example, the formulation may include at least about 45 wt % of the abrasive grains, such as at least about 55 wt % of the abrasive grains. In general, the formulation includes not greater than 90 wt % of the abrasive grains, such as not greater than 85 wt % of the abrasive grains.

Generally, the formulation, including the polymer formulation, the abrasive grains, and optional reinforcing particulate, forms a surface feature layer. Once formed into a layer, the formulation exhibits mechanical properties that advantageously enhance the performance of the abrasive article formed of the formulation. In particular, the formulation may exhibit desirable mechanical properties, such as elongation-at-break, hardness, tensile modulus, or tensile strength. In addition, the abrasive article may be evaluated for performance in producing surface characteristics desirable in an abraded product.

In an exemplary embodiment, the formulation exhibits an elongation-at-break of at least about 50%, for example, measured using test method ASTMD 412 or test method DIN 53 504 S 1. In particular, the elongation-at-break may be at least about 100%, such as at least about 125%, or even at least about 135%.

The cured formulation may also have a desirable hardness, such as a hardness in a range of about 50 shore A to about 75 shore D based on testing method DIN53 505. For example, the hardness may be not greater than about 75 shore D, such as not greater than 60 shore D, or not greater than 50 shore D.

In another exemplary embodiment, the formulation exhibits a desirable tensile modulus of not greater than about 8.0 MPa at 100% strain based on ASTM D 412. For example, the tensile modulus may be not greater than about 7.6 MPa, such as not greater than about 7.5 MPa. In addition, the cured formulation may have a desirable tensile strength of at least about 7.0 MPa based on ASTM D 412. For example, the cured formulation may have a tensile strength of at least about 7.5 MPa, such as at least about 8.0 MPa. Alternatively, the formulation may exhibit a tensile modulus of at least about 8

MPa, such as at least about 14 MPa, or even at least about 30 MPa. Particular formulations may exhibit a tensile modulus of greater than 100 MPa.

The mechanical properties of the formulation may contribute to the performance of the abrasive article, such as advantageously contributing to surface characteristics achievable by an abrasive article formed from such a formulation. For example, the mechanical properties of the cured formulation may contribute to surface performance characteristics, such as Gloss Performance or Roughness Performance, as defined below. Further, the abrasive article may exhibit desirable material removal rates as characterized by the Removal Index defined below.

In an exemplary embodiment, the formulation may form a surface feature layer of an abrasive article. FIG. 1 includes an illustration of an exemplary structured abrasive article 100. Alternatively, the formulation may be used in forming other non-structured coated abrasive articles or bonded abrasive articles. Typically, a structured coated abrasive article includes a coated abrasive article having an assembly of protruding surface structures, typically arranged in a pattern.

Structured abrasive articles, also called engineered abrasive articles, contain a plurality of abrasive grains dispersed in a binder and formed into discrete three-dimensional units either in a pattern or a random array on or throughout the abrasive article. Structure abrasive articles typically have a relatively high material removal rate in combination with a fine surface finish and long life. These articles are designed to wear away, continually exposing fresh abrasive to the grinding interface. However, most structured abrasive articles are designed for high force applications. Thus, when used in low force applications, the resinous binder does not break down or wear away to expose new abrasive grains.

The exemplary structured abrasive article 100 illustrated in FIG. 1 includes an abrasive layer 102. The abrasive layer 102 includes protruding structures 108, which may be arranged in a pattern. In the illustrated embodiment, the protruding structures 108 are configured to provide increasing contact area in response to wear, as in the case of protrusions with sloping side surfaces. For example, the structures 108 may have a cross-section that decreases with increased distance from the base of the abrasive layer 102. Typically, the abrasive layer 102 is formed from a formulation that includes a polymer formulation, reinforcing particulate, and abrasive grains. For example, the formulation may be formed into a patterned layer and cured or set to produce the abrasive layer 102 having structures 108.

In an exemplary embodiment, the abrasive layer 102 may be formed with a backing or support layer. The backing is typically directly bonded to and directly contacts the abrasive layer 102. For example, the abrasive layer 102 may be extruded onto or calendered onto a backing. The backing or support may include a polymer film, a polymer foam, or a fibrous fabric. In a particular example, the backing or support may include cloth, paper, or any combination thereof. Typically, the backing or support layer is a non-abrasive layer that does not include abrasive grains. The backing or support layer generally provides structural support or imparts mechanical properties to the abrasive article without which the abrasive layer 102 would perform poorly.

Alternatively, the abrasive article 100 may be free of a backing layer. Particular formulations used to form the abrasive layer 102 provide desirable mechanical properties and can be self-supporting. That is, the abrasive layer 102 can be configured to not have reliance on a backing layer in use or during manufacture. For example, a self-supporting abrasive layer 102 may withstand use without structural degradation prior to the abrasive properties being consumed. In particular, the properties of the polymer in the formulation may permit formation of the abrasive article 100 without a backing layer, which may have particular advantages over the state of the art that generally requires use of a backing to carry the abrasive layer through the coating process and to provide mechanical integrity or flexibility during use. In particular, the abrasive layer 102 may be self-supporting without the presence of an underlying support or backing layer. Such underlying support or backing layers traditionally have tensile properties, such a combination of strength and flexibility, that are superior to those of traditional abrasive layers. In this particular embodiment, the abrasive article 100 is free of a layer having tensile properties superior to the tensile properties of the abrasive layer 102.

Figure 7:
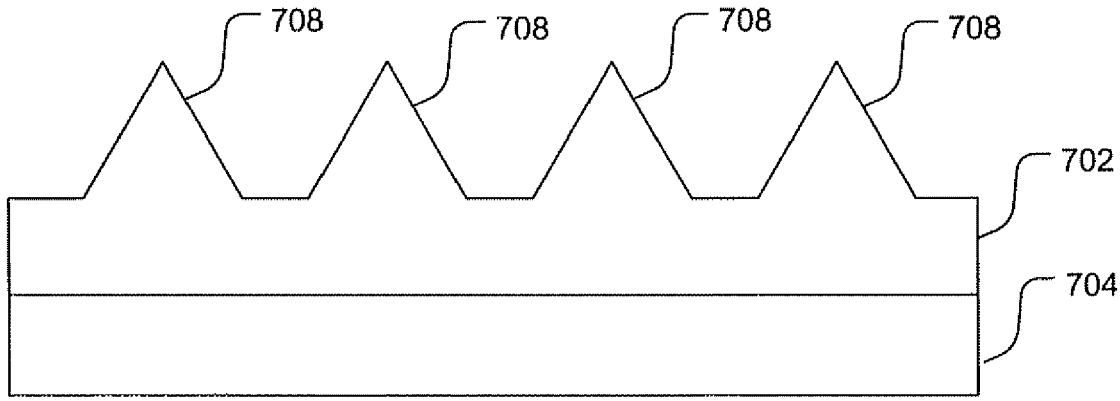
FIG. 7 includes an illustration of a cross-sectional view of an exemplary structured abrasive article.

In addition to the abrasive layer 102, the abrasive article 100 may include an adhesion layer 104. For example, the adhesion layer 104 may include a pressure sensitive adhesive or a cured adhesive. When the adhesive is used to bond the abrasive article to an abrading tool, a release film may cover the abrasive layer to prevent premature adhesion. Such release films are typically removed just prior to attachment of abrasive article 100 to an abrading tool. In a particular embodiment illustrated in FIG. 7, an adhesion layer 704 may form an underside surface, such as a pressure sensitive adhesive surface, and an abrasive layer 702 having surface features 708 may form an abrasive upper surface. In particular, the adhesion layer 704 is in direct contact, such as without intervening structural layers, with the abrasive layer 702.

In another exemplary embodiment, the adhesion layer 102 may bond to a fastener sheet 106. In particular, the fastener sheet 106 may function to couple the abrasive product to an abrading machine. In an example, the fastener sheet 106 is not configured to provide structural support to the abrasive article. For example, the fastener sheet 106 may have a tensile strength that is less than that of the abrasive layer 102. In an example, the fastener sheet 106 may be one component of a hook and loop fastening system. Such a fastening system may be used to couple the abrasive article 100 to an abrading tool.

Figure 2:
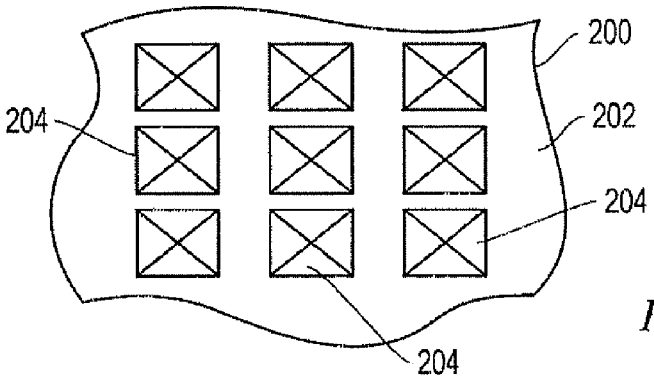
FIG. 2 and FIG. 3 include illustrations of exemplary surface feature layers in the form of patterns of surface protrusions in an exemplary structured abrasive article.
Figure 3:
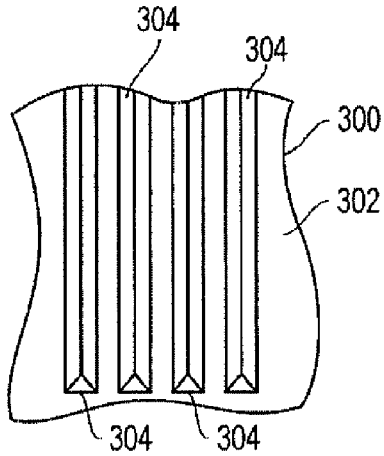

The structures 108 of the abrasive article 100 may be arranged in a pattern. For example, FIG. 2 and FIG. 3 include illustrations of exemplary patterns of abrasive structures. In an exemplary embodiment, FIG. 2 illustrates a pattern 200 of abrasive structures 204 incorporated into an abrasive layer 202. For example, the abrasive structures 204 are arranged in a grid pattern. In another exemplary embodiment, FIG. 3 includes an illustration of a pattern 300 in which prismatic abrasive structures 304 are incorporated into an abrasive layer 302. As illustrated, the prismatic structures 304 are arranged in parallel lines. Alternatively, the structures may be arranged randomly with no defined pattern, or elements may be offset from one another in alternating rows or columns. In an additional example, the structures 108 may be discrete protrusions having sloped side walls. In another example, the structures 108 may be discrete protrusions having substantially vertical side walls. The structures 108 may be arranged in an array having a pattern or may be arranged in a random array.

Figure 4:
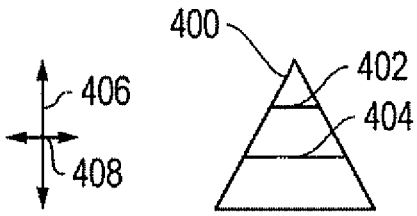
FIGS. 4 and 5 include illustrations of exemplary cross-sections of surface features of an exemplary structured abrasive article.
Figure 5:
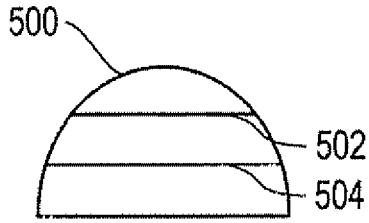

In one embodiment, the abrasive structures protruding from the abrasive layer are configured to increase in contact area in response to wear. For example, FIG. 4 and FIG. 5 include illustrations of exemplary cross-sections of abrasive structures. FIG. 4 includes an abrasive structure 400 having a triangular cross-section. With a first degree of wear, the contact area indicated by width 402 is less than the contact area resulting from additional wear, such as contact area 404. Typically with decreasing vertical height as indicated by 406, the contact area generally formed in a horizontal plane as indicated by 408 increases. In another exemplary embodiment, the structure may have a semicircular cross-section 500 in which a contact surface 504 is greater than contact surfaces, such as surface 502, resulting from less wear. While the vertical cross-sections illustrated in FIG. 4 and FIG. 5 are regular shapes, the structures or protrusions may be irregularly shaped or regularly shaped. If regularly shaped, the protrusions may have a horizontal cross-section, such as a circle or a polygon.

Returning to FIG. 1, the formulation described above has been found to be particularly useful in forming particular structured abrasive articles, especially those without a support or backing layer, and including thin structures. In an exemplary embodiment, the abrasive layer 102 has a total height as denoted by letter B not greater than about 500 mils, such as not greater than about 350 mils, not greater than about 200 mils, not greater than about 100 mils, not greater than about 50 mils, or even not greater than about 35 mils. The abrasive structures 108 may be not greater than about 20 mils, such as not greater than about 15 mils. Further, the width of the abrasive layer 102 not including the abrasive structures 108, as denoted by letter C may be not greater than about 15 mils, such as not greater than about 10 mils.

Figure 6:
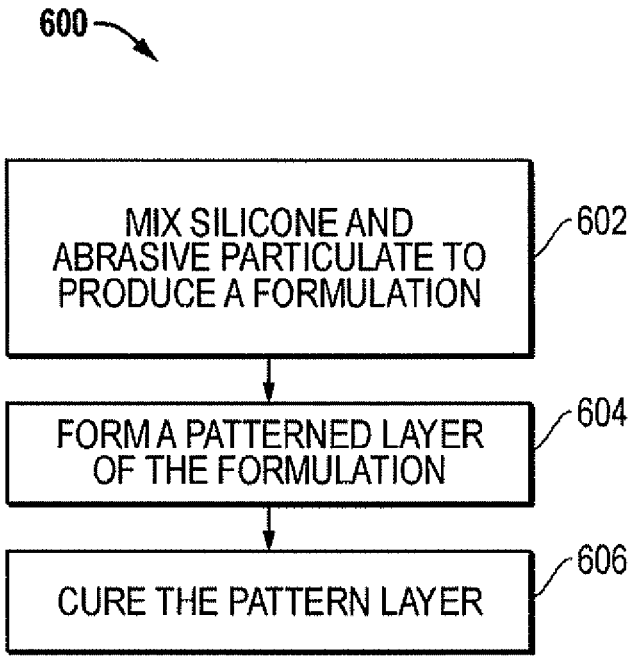
FIG. 6 includes a flow diagram illustrating an exemplary method for forming an exemplary structured abrasive article.

In an exemplary embodiment, the abrasive article may be formed using a method 600, as illustrated in FIG. 6. For example, a silicone and abrasive grains may be mixed, as illustrated at 602. In a particular embodiment, a liquid silicone rubber that includes silica reinforcing particulate is mixed with abrasive grains to form an uncured formulation. Further, the mixing may include mixing parts A and B of a liquid silicone rubber. Alternatively, the mixing may include mixing a silicone oil, a reinforcing particulate, and abrasive grains in one of various orders to form the formulation.

The formulation may be used to form a patterned layer, as illustrated at 604. For example, the patterned layer may include a pattern of surface structures configured to provide increased contact area in response to wear. For example, the cured formulation may be extruded or calendered into a sheet. The sheet may be stamped, engraved, or generally patterned or any combination thereof to provide the patterned surface structures. In another exemplary embodiment, the formulation may be extruded or calendered onto a negative surface including a negative pattern that is imparted to form the pattern of the patterned layer.

Once the patterned layer is formed of the uncured formulation, the formulation may be cured, as illustrated at 606. In the case of a platinum catalyzed silicone, the formulation and the patterned layer formed thereof may be heated and thus, thermally cured. In alternative embodiments, a catalyst system that reacts to actinic radiation may be used. Typical conditions of curing are 5 mins at 350° F.

A similar method may be implemented using thermoplastic polymer formulations. For example, a thermoplastic polymer formulation may be blended with abrasive grains and optional reinforcing particulate. Such blending may be performed in an extruder or a heated blender. The blended formulation including the polymer formulation, abrasive grains, and reinforcing particulate, may be extruded and patterned. For example, surface patterns may be formed in a surface of an extruded layer of the blended formulation using stamps, rollers, or other patterning techniques. In particular example, the blended formulation may be extruded onto a negatively patterned mold. The blended formulation may cool to form the abrasive layer. An adhesion layer or a fastener layer may be added to form the abrasive product. Alternatively, the method may be adapted for use of a thermoplastic vulcanate.

While embodiment of the abrasive article may be useful in various industrial applications, particular embodiments of the abrasive article have advantageous use in surface treatment industries, such as the optical media repair industry. For example, a treated surface, such as an optical media or a painted surface can be abraded using a pre-sanding treatment. Pre-sanding typically is performed using a coarse grain abrasive article and generally removes large surface defects, leaving a matte finish. In an exemplary embodiment, the pre-sanded surface is further abraded using an abrasive article having a smaller grain size than the coarse grain abrasive. For example, the pre-sanded surface may be further abraded using an abrasive article formed from a formulation described above. The formulation may include a polymer formulation, a silica reinforcing particulate, and abrasive grains.

In another example, the pre-sanded surface may be further abraded using an abrasive article including a layer having a surface pattern configured to increase in surface area with wear. The layer may include a polymer formulation and abrasive grains. The abrasive article may be free of a backing layer.

After abrading, the abraded surface may be buffed or polished. For example, the abraded surface may be buffed or polished with a wool pad or a foam pad. The buffed or polished surface typically has a desirable roughness and gloss.

In a particular embodiment, the abrasive article may be used to repair optical media, such as CDs or DVDs. For example, a CD or DVD rental establishment or reseller may receive a used optical media. In an example, the establishment may receive the optical media through a store front. In another example, the establishment may receive the optical media via mail. The CD or DVD may be abraded with an abrasive article formed as described above. In particular example, the abrasive article does not include a backing layer. In another example, the abrasive article may include a pressure sensitive adhesive surface. The CD or DVD may be cleaned and polished. Subsequently, the CD or DVD may be provided for subsequent use, such as rented again or sold. In particular, such abrasive articles are useful in process in which no subsequent coating process is used and abrading with the abrasive article may impart dirt or dust resistance to the polished surface.

Particular embodiments of the abrasive article advantageously provide improved surface characteristics when used. For example, use of particular embodiments of the abrasive article may exhibit improvements in roughness and gloss in abraded surfaces. For example, Gloss Performance may be defined as the average gloss of a surface prepared using the abrasive article. A two-foot by four-foot area of a freshly painted metallic surface may be first sanded or pre-sanded with 3M 260L P1500 available from 3M. Such a pre-sanding typically produces a surface having an average roughness (Ra) of between 7.8 and 9 micro inches as measured using a Mahr-Federal Perthometer M2. The pre-sanded painted surface is sanded for a period of 1 minute using the abrasive article to be tested. The average roughness and 60 degree gloss (Micro Tri-Gloss meter from Tricor-systems) are measured. The Gloss Performance is the average gloss of the sanded article following the above-described procedure. Particular embodiments of the abrasive article may produce an average Gloss Performance of at least about 25, such as at least about 26, or at least about 28.5, measured in terms of gloss or reflectance at 60°. Gloss Performance depends strongly on grit size of grain. For example, coarser grits like J400 or higher can give gloss less than 20 while very fine grits like J3000 can give a gloss of 60. When the grit size is consistent between two samples, the binder formulation and reinforcing particulate can influence the Gloss Performance. In addition, a Roughness Performance is defined as the average roughness (Ra) for a surface prepared in the above manner. Particular embodiments of the abrasive article may exhibit a Roughness Performance of not greater than about 3.5, such as not greater than about 3.1, or even, not greater than about 2.6 as measured in units of microinches.

In a further example, a Roughness Index and a Removal Index may be defined based on the performance of an abrasive article on an acrylic sheet. An abrasive product is attached to pressure driven, Hutchin's random orbital sander. The product is sanded on 6 acrylic panels that are pre-sanded with 3M 260L 1500. The total sanding time is 3 minutes, at 30 s per panel. After 30 seconds, the acrylic panel is measured for loss of weight and surface roughness Ra measured in microinches. The Removal Index is defined as the cumulative loss in weights of the six acrylic panels and the Roughness Index is defined as the average roughness Ra of the first acrylic panel. In particular, the Roughness Index for an abrasive product may be not greater than 6.0, such as not greater than 5.0, not greater than 4.0, or even not greater than 3.0, as measured in units of microinches. In a further example, the Removal Index may be at least about 0.1, such as at least about 0.2, at least about 0.3, or even at least about 0.5, as measured in grams.

EXAMPLES

Example 1

Mechanical properties of a layer formed from a silicone-based formulation are measured. The formulation is formed by mixing Elastosil® 3003 LR50 liquid silicone parts A and B, available from Wacker Silicones, and approximately 60 wt % J800 silicon carbide abrasive grains, available from Nanko, based on the total weight of the formulation. Elastosil® 3003 LR50 is a two-part liquid silicone including premixed silica reinforcement at an estimated content of about 33 weight %. This corresponds to about 13 weight % of silica in the entire formulation. Elastosil® 3003 LR50 absent abrasive grains has a viscosity at a shear rate of 10 $s^{-1}$ (DIN 53 019) of about 360,000 cps and when cured in the absence of abrasive grains, has a tensile strength of about 10.6 MPa and an elongation of 520% (DIN 53 504 S1). The formulation is cured in a heated mold at 175° C. for 5 minutes under pressure.

The cured formulation exhibits a tensile strength of approximately 7.76 MPa (1126 psi) and an elongation-at-break of approximately 137% (ASTM D 412). In addition, the cured formulation exhibits a 100% modulus of approximately 7.22 MPa (1048 psi) and a Shore A hardness of 83.

Example 2

Two backless abrasive samples are compared with Trizact 443SA P3000, available from 3M. Sample 1 is formed from a formulation including Wacker® Silicone Elastosil® 3003 LR50 and 65 wt % WA800 alumina abrasive grains and includes a pattern of structural pyramids having a square base with 500 micrometer sides and a height above the surface of approximately 250 micrometers. Sample 1 is cured in a mold heated to approximately 350° F. and cooled down to approximately 100° F. over a cycle time of approximately 45 minutes. Sample 2 is prepared from a formulation including Wacker® Silicone Elastosil® 3003 LR50 and 60 wt % J800 silicon carbide abrasive grains in the manner described above.

To test the performance of the samples, portions of a freshly painted hood are pre-sanded with 3M 260L P1500 to an average roughness (Ra) of between approximately 7.8 and approximately 9.0 microinches. The portions are sanded using one of the Samples 1 or 2 or the comparative sample for a period of 1 minute. Table 1 illustrates the Roughness Performance and Gloss Performance of the samples.

TABLE 1

Roughness and Gloss Performance

| | Sample 1 | Sample 2 | Comparative Sample - 3M Trizact P3000 |
|---|---|---|---|
| Roughness (micro inches) | 3.3 | 3.4 | 3.3 |
| Gloss Performance (%) | 28.9 | 26.1 | 13.5 |

No defects are observed in the surfaces for Sample 1, Sample 2, or the comparative sample. Both Sample 1 and Sample 2 exhibit similar Roughness Performance compared to 3M's Trizact P3000. However, Samples 1 and 2 exhibit improved Gloss Performance, approximately 100% greater than the comparative sample.

Example 3

Two backless abrasive samples are prepared using different loadings of reinforcing silica. Sample 3 is prepared from a formulation including Wacker® Silicone Elastosil® 3003 LR50 and 60 wt % J800 silicon carbide abrasive grains in the manner described above. Sample 3 contained about 13% of a fumed silica. Sample 4 is prepared by mixing DMS-V31 vinyl terminated polydimethyl siloxane, HMS-301 hydride crosslinker, and SIP 6829.2 platinum catalyst, each available from Gelest, Inc, Morrisville, Pa., with 10 parts per hundred Cabosil M5 fumed silica, available from Cabot Corporation, to form a mixture. The mixture is subsequently mixed with 60 wt % J800 silicon carbide. Sample 4 contains about 4% of fumed silica.

The samples are tested and compared with Trizact 443SA P3000, available from 3M on portions of a surface painted with Spies-Hecker clearcoat and presanded with 3M 260L P1500 to a roughness in the range of 6.3 to 7.3 microinches. The sanding time for each product was 1 minute over the same area of the hood. Table 2 illustrates the resulting Roughness and Gloss Performance of the samples.

TABLE 2

Roughness and Gloss Performance

| | Sample 3 | Sample 4 | Comparative Sample |
|---|---|---|---|
| Roughness Performance | 2.4 | 3.1 | 2.5 |
| Gloss Performance | 29.2 | 18.3 | 16.9 |

No defects are observed in the abraded surfaces. Both Sample 3 and Sample 4 exhibit improved Gloss Performance over the comparative sample. However, Sample 3, which has a greater loading of silica reinforcing agent, exhibits a greater improvement in Gloss Performance and an improvement in Roughness Performance.

Example 4

A backless abrasive sample is compared with Trizact 443SA P3000, available from 3M. Sample 5 is formed from a formulation including Wacker® Silicone Elastosil® 3003 LR50 and 60 wt % J800 silicon carbide abrasive grains and includes a pattern of structural pyramids having 45 pyramids per linear inch. Sample 5 is cured in a mold heated to approximately 350° F. and cooled down to approximately 100° F. over a cycle time of approximately 45 minutes.

To test the performance of the samples, portions of a freshly painted hood, painted with Spies-Hecker Clear coat, are pre-sanded with 3M 260L P1500 to an average roughness (Ra) of between approximately 7.8 and approximately 9.0 microinches. Subsequently, the portions are sanded using Sample 5 or the comparative sample for a period of 1 minute. Table 3 illustrates the Roughness Performance and Gloss Performance of the samples.

TABLE 3

| | Sample 5 | Trizact 443SA P3000 |
|---|---|---|
| Ra (u") | 3.9 | 2.9 |
| 60 deg Gloss (%) | 24 | 14 |
| Comments | Glossy finish | Matt finish |

Sample 5 exhibits a Gloss Performance that is higher than that of the comparative product.

Example 5

Two backless abrasive samples are compared with Trizact 443SA P3000, available from 3M. Samples 6 and 7 are formed from a formulation including Wacker® Silicone Elastosil® 3003 LR50 and 60 wt % J800 silicon carbide abrasive grains and includes a pattern of structural pyramids having 45 pyramids per linear inch. Sample 6 is formed through compression molding and Sample 7 is formed by extrusion and embossing.

To test the performance of the samples, portions of a freshly painted hood, painted with Spies-Hecker Clear coat, are pre-sanded with 3M 260L P1500 to an average roughness (Ra) of between approximately 7.8 and approximately 9.0 microinches. Subsequently, the portions are sanded using one of Samples 6 or 7 or the comparative sample for a period of 1 minute. Table 4 illustrates the Roughness Performance and Gloss Performance of the samples.

TABLE 4

| | Sample 6 | Sample 7 | Trizact 443SA P3000 |
|---|---|---|---|
| Ra (u") | 4.6 | 4.5 | 3.3 |
| 60 deg Gloss (%) | 16 | 15 | 11 |

Both Sample 6 and Sample 7 exhibit improved Gloss Performance relative to the comparative sample.

Example 6

Two backless abrasive samples are compared with Trizact 443SA P3000, available from 3M. Samples 8 and 9 are formed from a formulation including Wacker® Silicone Elastosil® 3003 LR50 and 60 wt % J800 silicon carbide abrasive grains. Sample 8 has a surface including 90 pyramids per linear inch and Sample 9 has a pattern with 45 pyramids per linear inch. Both samples are formed through compression molding.

To test the performance of the samples, portions of a freshly painted hood, painted with Spies-Hecker Clear coat, are pre-sanded with 3M 260L P1500 to an average roughness (Ra) of between approximately 7.8 and approximately 9.0 microinches. Subsequently, the portions are sanded using one of Samples 8 or 9 or the comparative sample for a period of 1 minute. Table 5 illustrates the Roughness Performance and Gloss Performance of the samples.

TABLE 5

| | Sample 8 | Sample 9 | Trizact 443SA P3000 |
|---|---|---|---|
| Ra (u") | 3.7 | 4.5 | 3.4 |
| 60 deg Gloss (%) | 21 | 16 | 11 |

Sample 8 exhibits improved Gloss Performance relative to Sample 9 and the comparative sample.

Example 7

Three backless abrasive samples are compared with Trizact 443SA P3000, available from 3M. Samples 10, 11 and 12 are formed from a formulation including Wacker® Silicone Elastosil® 3003 LR50 and 60 wt % J800 silicon carbide abrasive grains. Sample 10 has a pattern of 90 pyramids per linear inch, Sample 11 has a pattern of 45 pyramids per linear inch, and Sample 12 has a random tri-helical pattern at 35 lines per inch.

To test the performance of the samples, portions of a freshly painted hood, painted with Spies-Hecker Clear coat, are pre-sanded with 3M 260L P1500 to an average roughness (Ra) of between approximately 7.8 and approximately 9.0 microinches. Subsequently, the portions are sanded using one of Samples 10, 11, or 12 or the comparative sample for a period of 1 minute. Table 6 illustrates the Roughness Performance and Gloss Performance of the samples.

TABLE 6

| | Sample 10 | Sample 11 | Sample 12 | Trizact 443SA P3000 |
|---|---|---|---|---|
| Ra (u") | 3.8 | 3.8 | 3.2 | 3.1 |
| 60 deg Gloss (%) | 18 | 17 | 26 | 14 |
| Comments | Glossy and uniform | Glossy and uniform | Very glossy, but modeled | Matt and uniform |

Sample 12 exhibits improved Gloss Performance relative to Samples 10 and 11 and the comparative sample.

Example 8

Two backless abrasive samples are compared with Trizact 443SA P3000, available from 3M. Samples 13 and 14 are formed from a formulation including Wacker® Silicone Elastosil® 3003 LR50 and 60 wt % J800 silicon carbide abrasive grains. Sample 13 has a surface including 45 pyramids per linear inch and Sample 14 has a pattern with 125 quads per linear inch.

To test the performance of the samples, portions of a freshly painted hood, painted with Spies-Hecker Clear coat, are pre-sanded with 3M 260L P1500 to an average roughness (Ra) of between approximately 7.8 and approximately 9.0 microinches. Subsequently, the portions are sanded using one of Samples 13 or 14 or the comparative sample for a period of 1 minute. Table 7 illustrates the Roughness Performance and Gloss Performance of the samples.

TABLE 7

| | Sample 13 | Sample 14 | Trizact 443SA P3000 |
|---|---|---|---|
| Ra (u") | 2.6 | 2.5 | 3.2 |
| 60 deg Gloss (%) | 35 | 36 | 11.7 |
| Comments | Glossy finish | Glossy finish | Matt finish |

Samples 13 and 14 exhibit comparable Gloss Performance, which is improved relative to the comparative sample.

Example 9

Two backless abrasive samples are compared with Trizact 443SA P3000, available from 3M. Samples 15 is formed from a formulation including Wacker® Silicone Elastosil® 3003 LR50 and 60 wt % J800 silicon carbide abrasive grains with 45 pyramids per linear inch. Sample 16 is formed from a formulation including Lotryl 29-Ma-03 and 75 wt % J800 silicon carbide abrasive grains with 45 pyramids per linear inch.

To test the performance of the samples, portions of a freshly painted hood, painted with Spies-Hecker Clear coat, are pre-sanded with 3M 260L P1500 to an average roughness (Ra) of between approximately 7.8 and approximately 9.0 microinches. Subsequently, the portions are sanded using one of Samples 15 or 16 or the comparative sample for a period of 1 minute. Table 8 illustrates the Roughness Performance and Gloss Performance of the samples.

TABLE 8

| | Sample 15 | Sample 16 | Trizact 443SA P3000 |
|---|---|---|---|
| Ra (u") | 2.7 | 3.7 | 2.8 |
| 60 deg Gloss (%) | 40 | 20 | 24 |
| Comments | Glossy finish | Modeled | Matt finish |

Sample 15 exhibits improved Gloss Performance relative to Sample 16 and the comparative sample.

Example 10

Backless abrasive samples are prepared and tested to determine Removal Index and Roughness Index as defined above. Those samples denoted as LSR2 are made from silicone oils—100 g of DMS-V31 vinyl terminated silicone with 3.5 g of HMS-301 hydride crosslinker and a suitable Pt catalyst. The liquids are mixed with the various amounts of fumed silica and J800 abrasive grain and cured to form the backless abrasive article. Table 9 illustrates the Removal Index and Roughness Index for the samples.

TABLE 9

| Formulation | Wt % silica | Removal Index (g) | Roughness Index (microinches) |
|---|---|---|---|
| LSR2 10 phr M5 60% J800 | 9 | 0.6 | 2.9 |
| LSR2 20 phr M5 60% J800 | 17 | 0.64 | 2.7 |
| LSR2 20 phr 812S 60% J800 | 17 | 0.61 | 2.5 |
| LSR2 35 phr 812S 60% J800 | 26 | 0.59 | 2.2 |
| LSR50 60% J800 | 33 | 0.56 | 1.9 |
| LSR50 60% J800 | 33 | 0.58 | 2.1 |

Table 9 generally illustrates that an increase in loading of filler particulate reduces Roughness Index while having little influence on Removal Index.

Example 11

Backless abrasive samples are prepared and tested to determine Removal Index and Roughness Index as defined above. The samples are prepared from various thermoplastic and thermoset materials and varying amounts and types of abrasive grain. Table 10 illustrates the Removal Index and Roughness Index for abrasive products formed from the various formulations.

TABLE 10

| | Wt % | Grain1 | | Grain2 | | Removal | Roughness |
|---|---|---|---|---|---|---|---|
| RESIN | Grain | Type | Grit | Type | Grit | Index | Index |
| Elastollan 1180A | 60 | SiC | J800 | | | 0.11 | 2.6 |
| Elastollan 1180A | 75 | SiC | J800 | | | | |
| Elvacite 4044 | 60 | SiC | J800 | | | 0.49 | 4.0 |
| Evatane 24-03 | 60 | SiC | J800 | | | 0.00 | |
| Evatane 40-55 | 60 | SiC | J800 | | | 0.00 | |
| Evatane 40-55 | 70 | SiC | J800 | | | 0.03 | 2.6 |
| Evatane 40-55 | 75 | SiC | J800 | | | 0.01 | 2.3 |
| Evatane 40-55 | 80 | SiC | J400 | SiC | J3000 | 0.54 | 5.2 |
| Evatane 40-55 | 80 | SiC | J600 | Alum | WA6000 | 0.29 | 2.9 |
| Lotader 3430 | 60 | SiC | J800 | | | 0.13 | 1.9 |
| Lotader 3430 | 75 | SiC | J800 | | | 0.25 | 2.7 |
| Lotader 3430 | 80 | SiC | J800 | | | x | x |
| Lotader AX 8900 | 60 | SiC | J800 | | | 0.21 | 1.7 |
| Lotader AX 8900 | 75 | SiC | J800 | | | 0.19 | 1.8 |
| Lotryl 15-MA-03 | 60 | SiC | J800 | | | 0.09 | 2.0 |
| Lotryl 29-MA-03 | 60 | SiC | J800 | | | 0.02 | 2.0 |
| Lotryl 29-MA-03 | 70 | SiC | J800 | | | 0.22 | 2.2 |
| Lotryl 29-MA-03 | 75 | SiC | J800 | | | 0.37 | 2.5 |
| Lotryl 29-MA-03 | 80 | SiC | J400 | SiC | J3000 | 0.42 | 5.0 |
| Lotryl 29-MA-03 | 84 | SiC | J600 | Alum | WA6000 | 0.49 | 3.5 |
| Lotryl 29-MA-03 | 80 | SiC | J600 | Alum | WA6000 | 0.22 | 3.0 |
| Lotryl 29-MA-03 | 80 | SiC | J600 | Alum | WA6000 | 0.28 | 3.5 |
| Lotryl 29-MA-03 | 80 | SiC | J600 | | | 0.36 | 3.6 |
| Lotryl 30-BA-02 | 60 | SiC | J800 | | | 0.13 | 2.1 |
| Orevac 18211 | 60 | SiC | J800 | | | 0.09 | 2.0 |
| Pebax 2533 | 60 | SiC | J800 | | | 0.04 | 3.3 |
| Pebax 2533 | 75 | SiC | J800 | | | 0.25 | 3.2 |

TABLE 10-continued

| RESIN | Wt % Grain | Grain1 Type | Grain1 Grit | Grain2 Type | Grain2 Grit | Removal Index | Roughness Index |
|---|---|---|---|---|---|---|---|
| PLA 2002D + Tegomer H-Si 6440 | 65 | SiC | J800 | | | 0.49 | 4.5 |
| Riteflex 430 | 60 | SiC | J800 | | | 0.23 | 2.3 |
| Riteflex 430 | 75 | SiC | J800 | | | 0.29 | 3.4 |
| Elastosil 3003 LR50 | 60 | SiC | J800 | | | 0.63 | 2.0 |

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A backless abrasive article comprising:

an abrasive layer having first and second major surfaces;

an adhesion layer in direct contact with the second major surface; and a fastener layer in direct contact with the adhesion layer, the fastener layer having a tensile strength less than that of the abrasive layer.

2. The backless abrasive article of claim 1, wherein the abrasive layer includes a polymer formulation and abrasive grains.

3. The backless abrasive article of claim 2, wherein the polymer formulation includes a thermoplastic polymer.

4. The backless abrasive article of claim 2, wherein the polymer formulation includes a silicone resin.

5. The backless abrasive article of claim 4, wherein the silicone resin is formed from a liquid silicone resin.

6. The backless abrasive article of claim 2, wherein the abrasive layer further includes a reinforcing particulate.

7. The backless abrasive article of claim 1, wherein the abrasive layer has an elongation-at-break of at least about 100%.

8. The backless abrasive article of claim 1, wherein the abrasive layer has a thickness of not greater than about 500 mils.

9. The backless abrasive article of claim 1, wherein the first major surface defines a set of protrusions.

10. The backless abrasive article of claim 9, wherein the set of protrusions are arranged in a pattern.

11. The backless abrasive article of claim 1, wherein the abrasive layer is self-supporting without the presence of an underlying support layer.

12. The abrasive article of claim 1, wherein the fastener layer is one component of a hook and loop fastening system.

13. An abrasive article comprising:

an abrasive layer having an array of protrusions, the abrasive layer having a thickness not greater than about 500 mils;

an adhesion layer in direct contact with the abrasive layer;

a fastener layer in direct contact with the adhesion layer, the fastener layer having a tensile strength less than that of the abrasive layer; and wherein the abrasive article is free of a backing layer.

14. The abrasive article of claim 13, wherein the thickness is not greater than about 350 mils.

15. The abrasive article of claim 13, wherein the adhesion layer forms a pressure sensitive surface configured to attach the abrasive article to an abrading machine.

16. The abrasive article of claim 13, wherein the fastener layer is one component of a hook and loop fastening system.

* * * * *